United States Patent [19]

Dale

[11] 3,957,117

[45] May 18, 1976

[54] METHOD AND APPARATUS FOR BOTTOM HOLE TESTING IN WELLS

[76] Inventor: Clarence R. Dale, 1900 E. Ocean Blvd., Long Beach, Calif. 90802

[22] Filed: Aug. 5, 1974

[21] Appl. No.: 494,727

[52] U.S. Cl. ..... 166/264; 166/169

[51] Int. Cl.[2] ..... E21B 49/00

[58] Field of Search ..... 166/264, 163, 169, 100, 166/168, 162; 73/151; 175/59

[56] References Cited

UNITED STATES PATENTS

| | | | |
|---|---|---|---|
| 2,303,727 | 12/1942 | Douglas | 166/100 |
| 2,312,805 | 3/1943 | Douglas | 166/100 |
| 2,441,894 | 5/1948 | Mennecier | 166/100 |
| 2,661,802 | 12/1953 | Johnston | 166/165 |
| 3,009,518 | 11/1961 | Taylor et al. | 166/100 |
| 3,047,072 | 7/1962 | Peters et al. | 166/264 |
| 3,095,930 | 7/1963 | Kisling | 166/163 |

*Primary Examiner*—Stephen J. Novosad
*Attorney, Agent, or Firm*—White and Haefliger

[57] ABSTRACT

Method and apparatus for bottom hole testing in producing or injection wells under pressure employing a tool adapted to be lowered on a flexible line to sampling depth in a well, the tool including a first section containing a closed sample chamber detachably connected to a second section containing time delay fluid escapement means operable to maintain the closed condition of the chamber until the sampling depth is reached and to then cause entry of a well fluid sample to the chamber followed by its closure to retain the sample and preserve the well pressure at the sampling location, the method including withdrawing the tool from the well, disconnecting the sections to recover the sample chamber independently of the second section, and transferring and opening the chamber for testing of its well fluid content.

22 Claims, 16 Drawing Figures

METHOD AND APPARATUS FOR BOTTOM HOLE TESTING IN WELLS

BACKGROUND OF THE INVENTION

Heretofore fluid sampling in producing and injection wells has been conducted using tools or instruments containing valve controlled sample receiving chambers which remain open while being lowered in the well to become closed after the sampling depth is reached. As a consequence, the samples ultimately received in the chambers may not have accurate correspondence with either the well fluid composition or pressure at the sampling depth in the well, and consequently laboratory analyses may be inaccurate or incomplete in significant respects.

Because of the frequent remoteness of adequate testing facilities for thorough and minute examination of samples taken at the well site, such examination if to be made would require transporting virtually the entire conventional sampling tool over long distances to well equipped laboratories, an often costly and impractical necessity because of equipment bulk and its removal from service.

SUMMARY OF THE INVENTION

The invention contemplates generally a novel method and apparatus to be used for deep or bottom hole testing and sampling in producing or injection wells whereby a sectional tool is lowered to sampling depth with delayed conditioning for sample admission to a pre-sealed chamber until that depth is reached. Following sample entry and sealing in one section of the tool the latter is raised to ground surface, the tool sections are disconnected and the well sample recovered in the chambered section for testing of its contents.

The apparatus comprises and the method employs a tool that may be characterized as having a first sealed and evacuated sample chamber section releasably connected to a second power or power source section whose functions include delayed actuation of valve means for admission of a well fluid sample to the chamber in the first section. Such valve means serves the dual functions of fluid admission to the sample chamber and sealing the sample therein to preserve the well pressure at the sample intake location.

Concerning the first or sample chamber section of the tool, its structural simplicity is of importance to the practicability and advantages of handling and transportation of the sample from the well site. In accordance with the invention the first section structure may be reduced essentially to a single tube forming the sample chamber having end joint sections containing sample inlet and pressure relief valves.

As to the second or power section of the tool, the invention broadly contemplates the use of any suitable and adaptable energy source for actuation, or delayed actuation, of the well fluid valve control means. However the invention presents a preferred and particularly unique power source possessing the capabilities of pretiming of its effective energy release, performance reliability and basic simplicity.

As will later appear in detail, energy for the well fluid admission control is derived from a body of pressurized fluid subject to restricted release so as to both control and time the well fluid entry to the sample chamber. Such pressurization and control are by the effects of a pressure gas source acting against a liquid body which by reason of its liquid vs. gas, and other compositional and viscosity properties, is amenable to controlled and predeterminable restricted escape productive of timed valve movement.

The invention has numerous features, objects and details all of which will be more fully understood from the following description of the accompanying drawings.

DESCRIPTION OF THE PREFERRED EMBODIMENTS

Figure 1A:
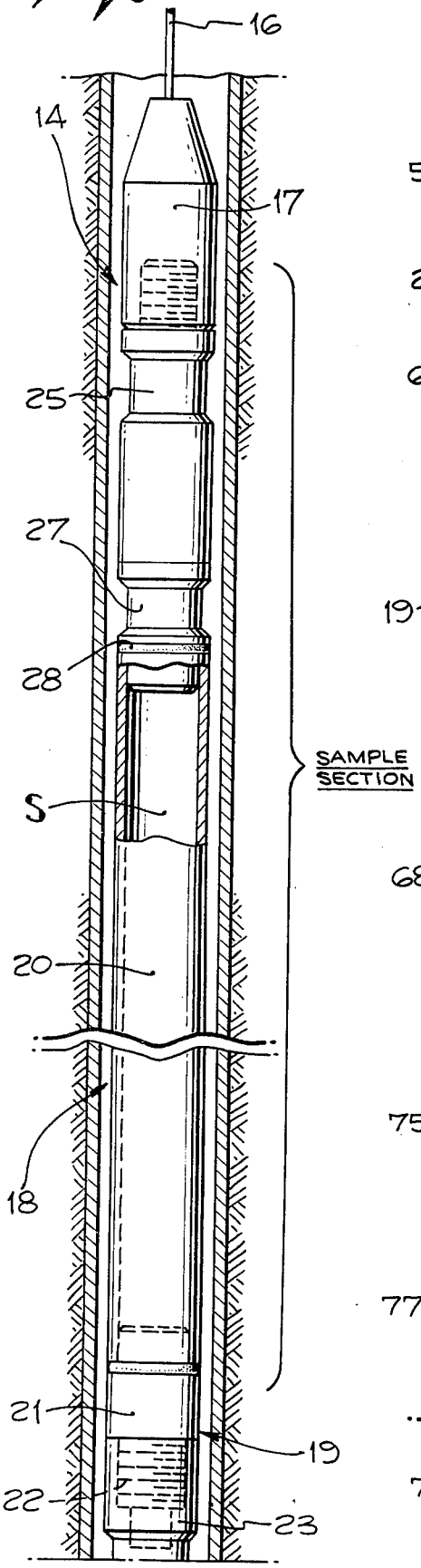
FIGS. 1*a* and 1*b* are longitudinally continuing views showing the tool in elevation within the well.
Figure 1B:
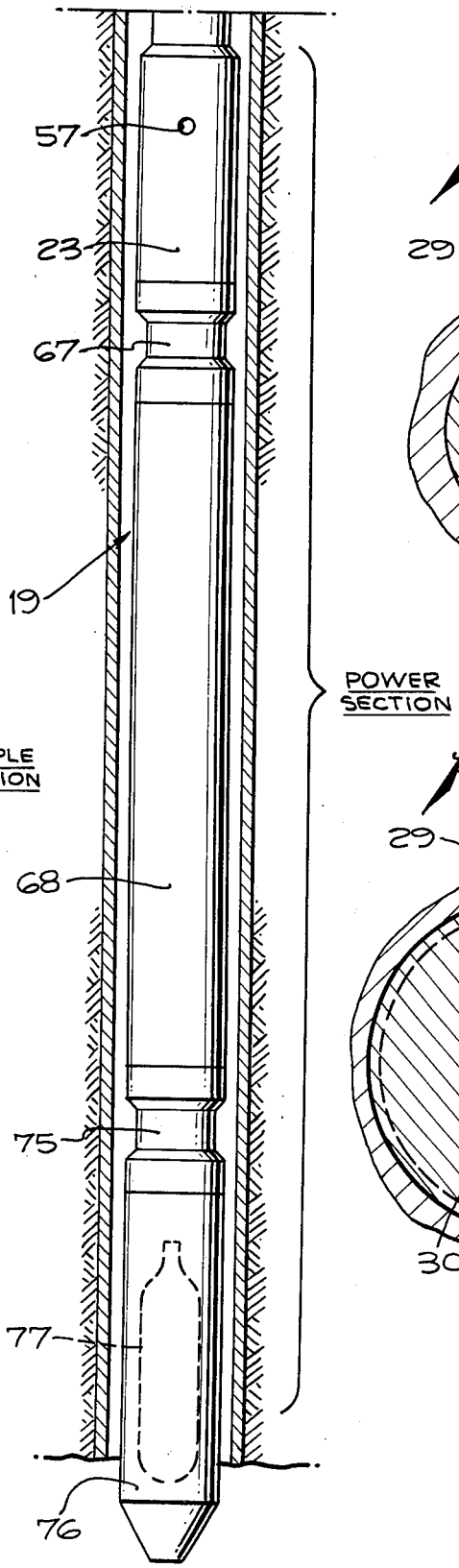
Figure 10:
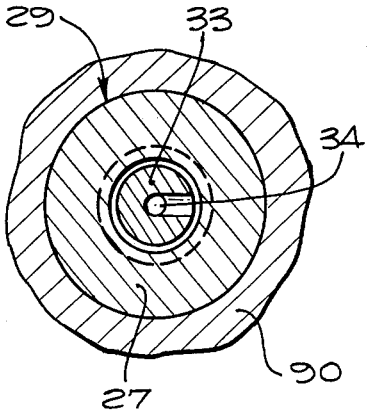
FIG. 10 is a cross section on line 10—10 of FIG. 8.
Figure 11:
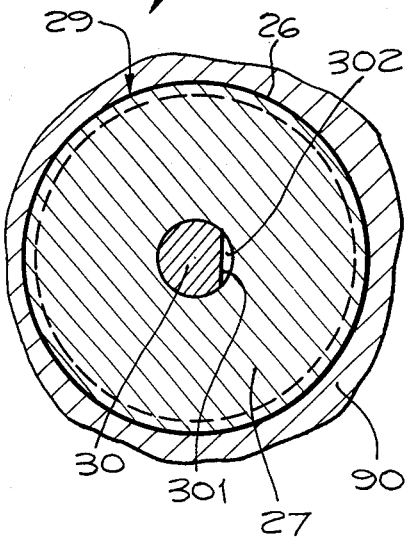
FIG. 11 is a cross section on lines 11—11 of FIG. 9.

Referring to the drawings the tool generally indicated at 14 is shown to be lowered in the casing 15 to at or near bottom hole depth on flexible wire line 16 connected to the tool by socket 17. As previously indicated the tool is characterized by having an upper section 18 and a disconnectable lower section 19, the former including preferably a one piece tube 20 forming the sample chamber S into the bottom of which the well fluid sample enters through sub 21 forming the lower end of section 18 and releasably threaded at 22 into the box end of sub 23 which defines the upper end of the lower power section 19. Fluid entry to chamber S occurs past check valves generally indicated at 24 in sub 21, the details of which will later appear. At its upper end the tool is connected by coupling 25 to socket 17 and at 26 to sub 27 welded at 28 to tube 20, the sub containing pressure relief valve generally indicated at 29.

Figure 7:
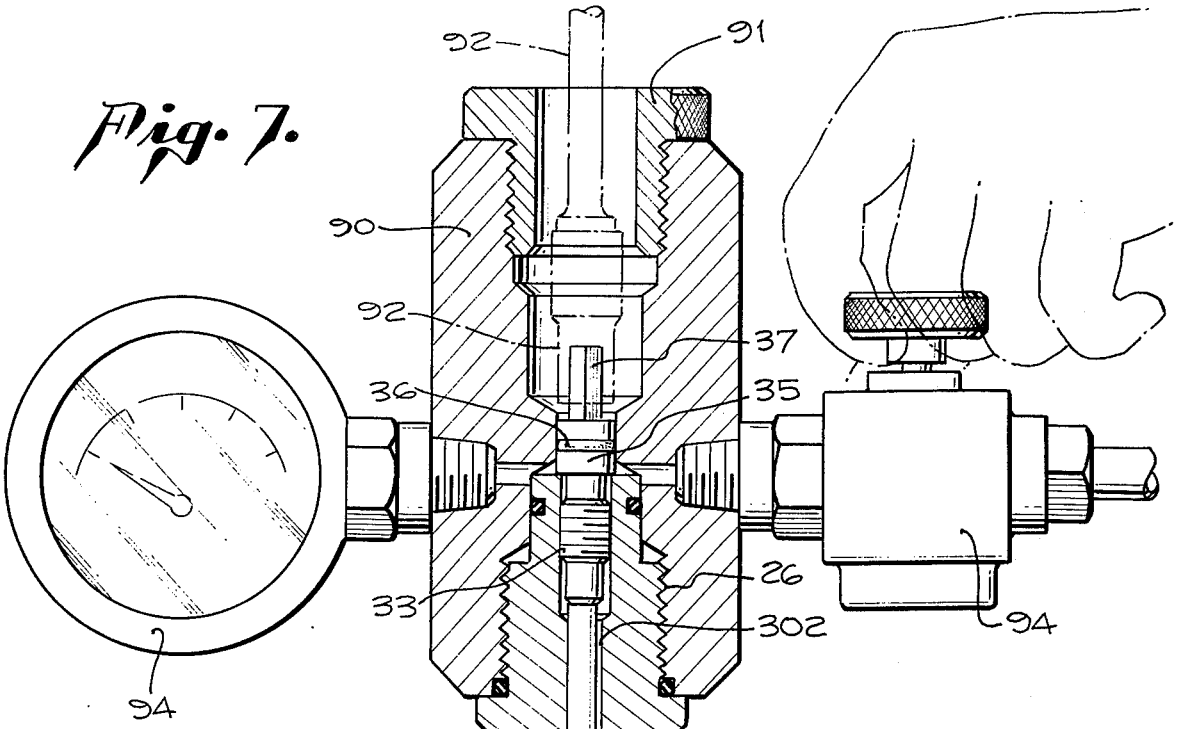
FIG. 7 is an enlarged sectional view illustrative of a pressure measuring-pressure release fixture connectible to the sample chamber section of the tool.
Figure 7:
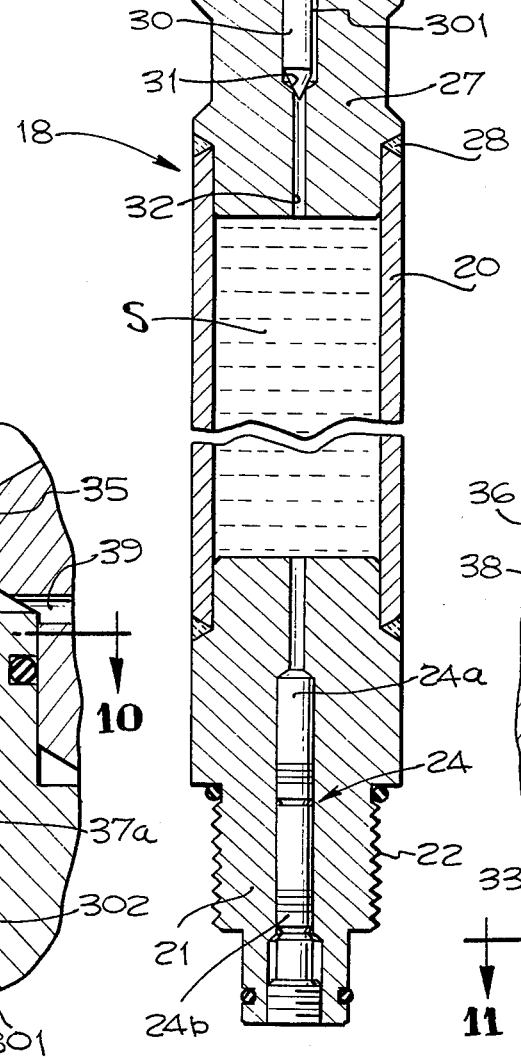
Figure 8:
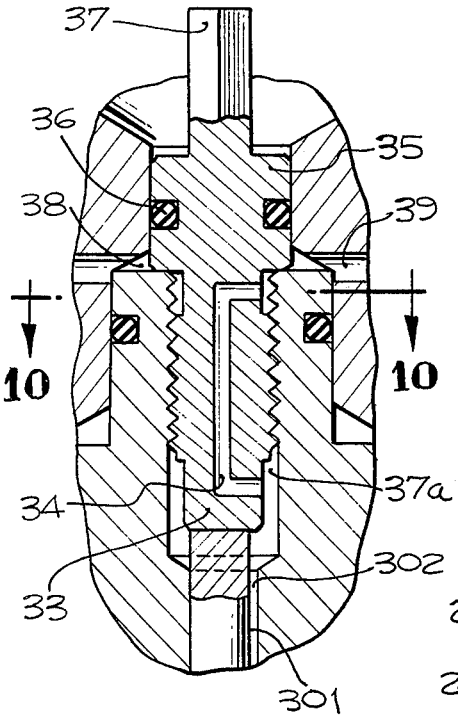
FIGS. 8 and 9 are enlarged fragmentary sections showing the changed positions of the pressure release assembly of FIG. 7.
Figure 9:
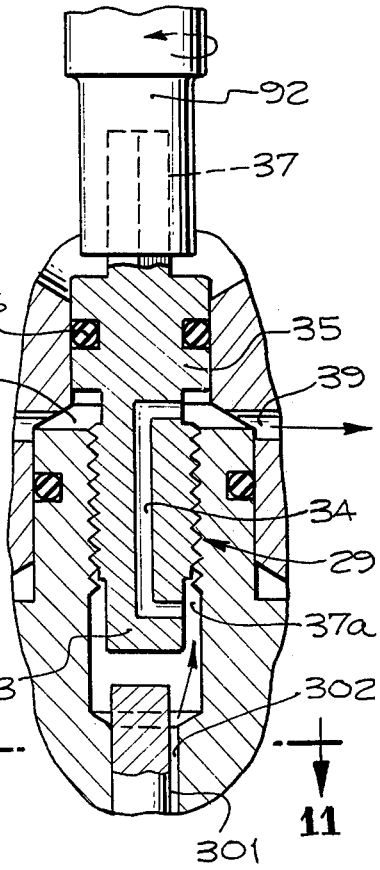

In further detailed reference to the pressure relief valve assembly and noting particularly FIGS. 7 and 8, the assembly includes a needle-valve 30 tightly seatable at 31 to seal against pressure release from the sample chamber through passage 32. For purposes in conjunction with pressure release the valve has a longitudinal gas escape groove 301 flat forming passage 302 which remains closed until the needle is released. The valve normally is held down by the engaging end of screw 33 threaded into the sub 27 and having a head 35 carrying seal ring 36 below the flat sided terminal 37 for reception of a wrench as will later appear. The body of screw 33 contains a passage 34 for pressure release gas escape from space 37*a* to space 38 and outlets 39.

Figure 6:
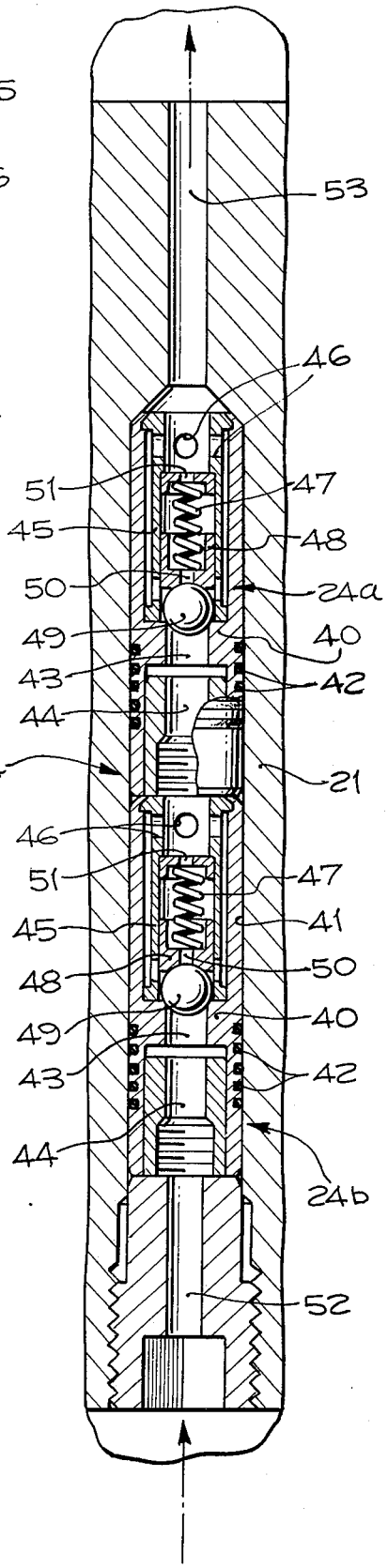
FIG. 6 is an enlarged cross section taken on line 6—6 of FIG. 3*a*.

To assure the preservation in the sample chamber S of the well pressure existing at the chamber intake location a pair of check valve assemblies 24*a* and 24*b* are used in tandem sequence as particularly detailed in FIG. 6. These may be of precision quality as manufactured by the Lee Company of Westbrook, Connecticut and sold under its trademark LEECHEK, see the Lee Company catalog copyrighted 1971. Each of the assemblies 24*a*, 24*b* comprise a body 40 received within the sub bore 41 wherein exterior leakage past body 40 is sealed by rings 42. The lower extent of the valve body has inlets 43 and 44, the latter being internally threaded to receive a tool to aid in insertion and withdrawal of the valve body from bore 41. Each body contains a cage 45 having a fluid outlet 46 above spring 47 exerting downward thrust against slide cup 48 which transmits the spring thrust against ball check 49. Normally the ball check closes fluids escape through openings 50, 51 and 46. As will appear the overall function of the tandem valve assemblies is to admit to the sample chamber S well fluid entering through passages 52 and 53 in the subs 23 and 21 and then to seal the sample in its chamber.

Figure 3A:
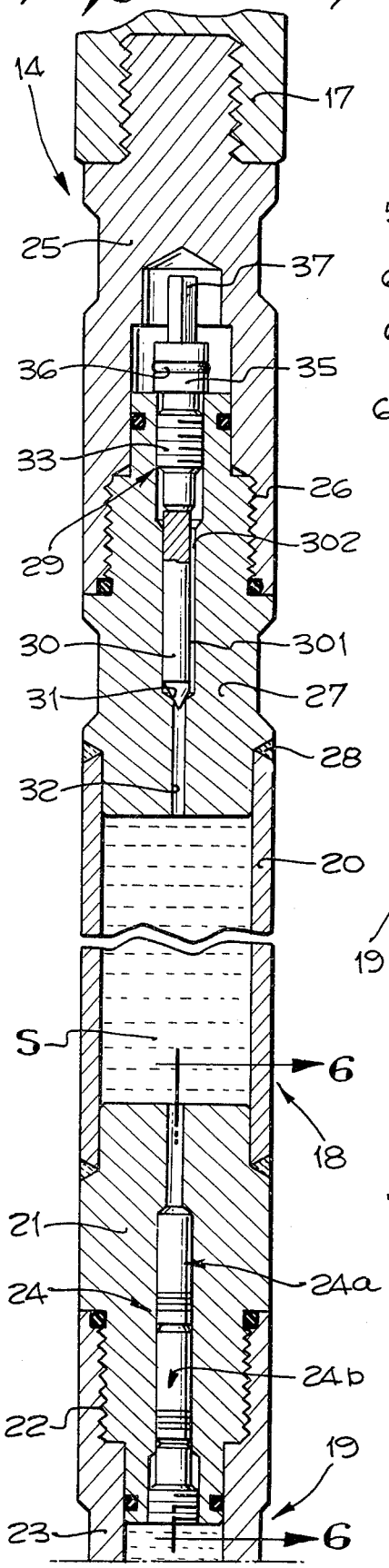
FIGS. 3*a*, 3*b* and 3*c* are similar views showing the piston-actuated inlet valve open for admission of well fluid to the sample chamber.
Figure 3B:
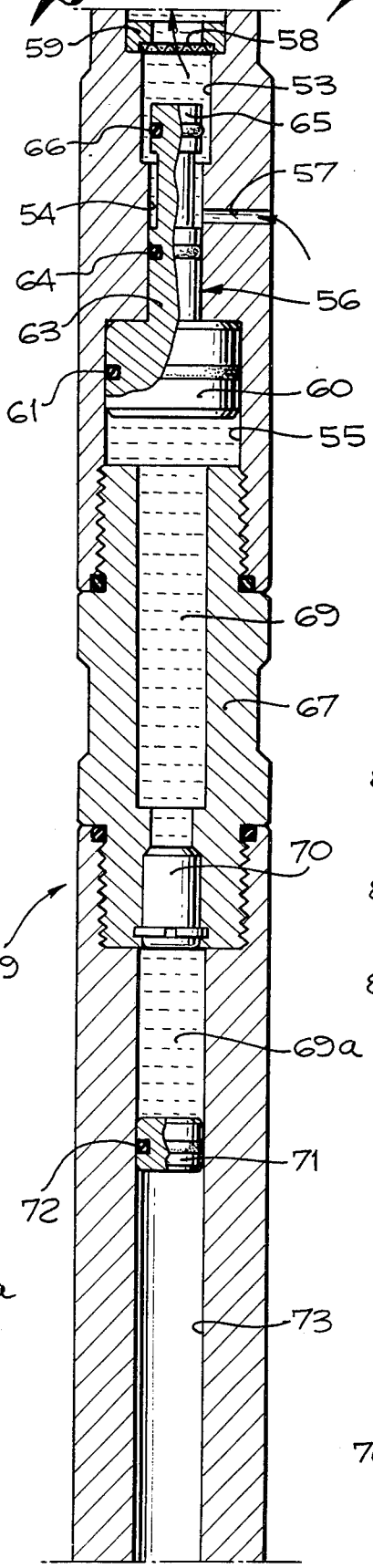
Figure 3C:
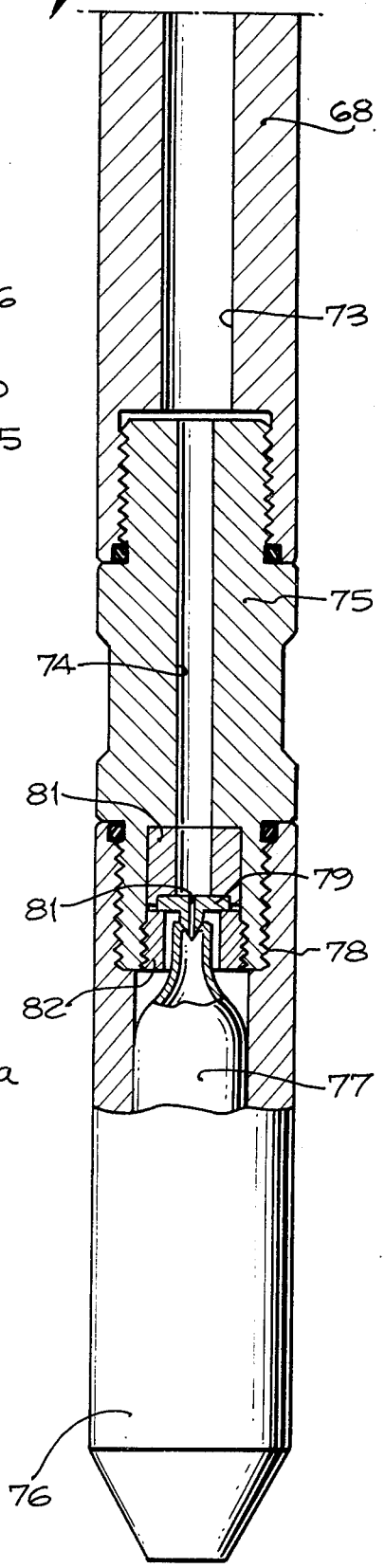

In particular reference to FIGS. 3*b* and 3*c* sub 23 contains in its bores 53, 54 and 55 a fluid pressure responsive valve structure generally indicated at 56 which controls well fluid entry through port 57, bores 54, 55 and screen 58 held down by ring 59 into the bottom check valve passage 52. The valve structure 56 is shown to comprise a larger diameter piston 60 having a seal ring 61 and reciprocable in bore 55, the piston being connected by rod 63 carrying seal ring 64 with smaller diameter valve piston 65 carrying seal ring 66. FIG. 3*b* shows the valve, i.e. 65 in open position for fluid entry to chambers past the check valves 24*a*, 24*b* as indicated by the arrow.

The power section subs 23, 67 and 68 contain a body of pressure transmitting liquid 69 itself pressurized below the restriction 70 by floating piston 71 carrying seal ring 72 and against which gas pressure is exerted through the sub bore 73 and bore 74 in sub 75 from a gas pressure source in the bottom or bull nose section 76 of the tool. Pressure transmission to the piston 60 occurs through bore 73 to the piston 71 and thence to the liquid at 69*a* below the restriction 70 which serves to delay fluid escape from below the restriction to the body 69 of liquid above the restriction and thus produce delayed responsiveness of valve structure 56 in its arrival at its well fluid admission position appearing in FIG. 3*b*:

The liquid constituting the bodies 69, 69*a* is selected for proper viscosity in relation to the degree of restriction at 70 and also for viscosity stability at sample intake temperatures existing in the well. For this purpose a Dow-Corning "200" silicone oil may be used, subject to viscosity variation as by dilution or supplementation at the well head in order that the well fluid admission to the tool may be controllably delayed to assure arrival of the tool at sampling depth in the well.

Satisfactory results have been achieved using as the restriction at 70 a Lee Company device identified in its catalog referred to above as "Lee Visco Jet" size 38 VL, part no. 38SVC5. The effect of the "Lee Jet" is to restrict with precision accuracy the escape of the silicone fluid passage through and past the device 70 that not until a predetermined delay following gas pressure application to the silicone liquid at 69*a* below the restriction will the latter pass sufficient liquid to elevate the valve assembly 56 from its initially closed FIG. 2*b* position to the open position of FIG. 3*b*. The quantity of silicone liquid used may be about one ounce.

Referring particularly to FIG. 3*c* the bottom tool section 76 is shown to contain a compressed or liquefied gas, typically carbon dioxide, contained in a capsule 77 which is initially closed. Just before the tool is lowered in the well the joint at 78 is made up and tightened to the FIG. 3*c* condition to cause the point of puncture point disc 79 to penetrate the top of the capsule, thereby releasing the gas through passage 80 for application of its pressure to the floating piston 71. The puncture point disc is clamped between its seat 81 and ring 82.

Figure 4:
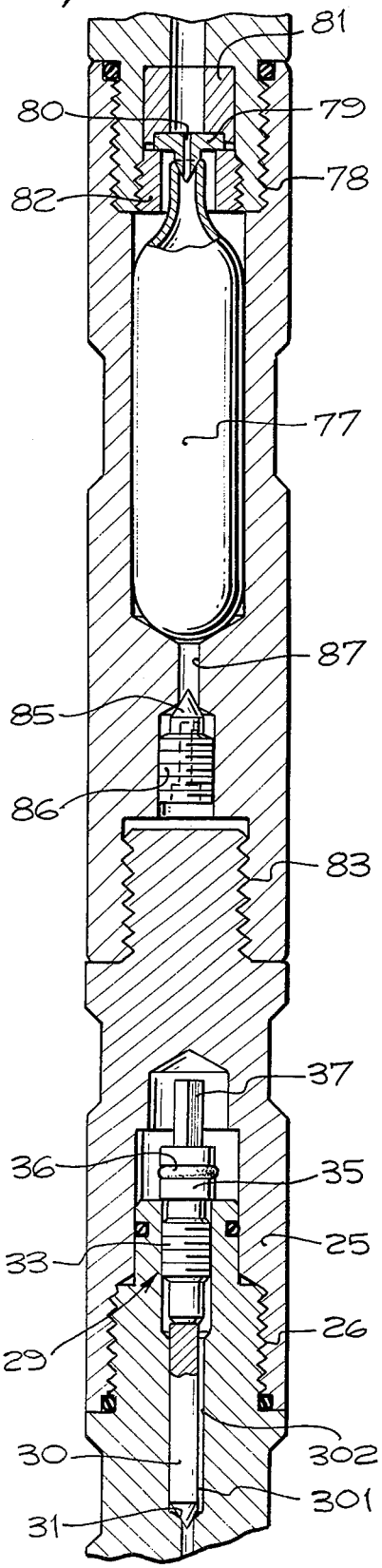
FIG. 4 is a fragmentary sectional view illustrative of coupling the tools in tandem relation.

As illustrated in FIG. 4, if for any reason it is desired to check one against the other the performances and results obtained by a pair of the tools under the same bottom hole conditions, a pair of the tools may be interconnected in tandem and run down together to sampling depth in the well. For this purpose sub 25 of the lower tool may be threaded at 83 onto the relief valve-containing sub 27 of the lower tool for tandem connection. Here as in the case of a single tool, needle 85 is held closed by screw 86 to seal against gas escape through passage 87 from the capsule chamber.

Figure 5:
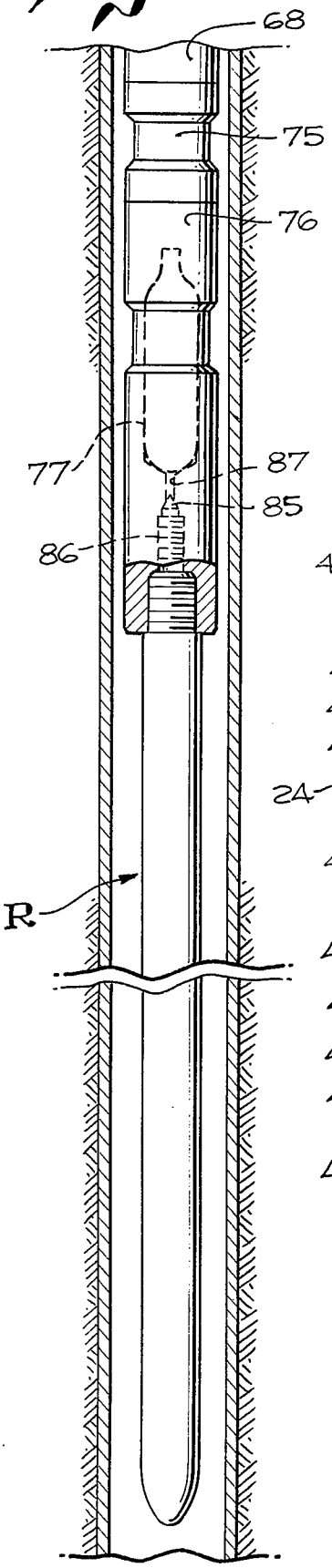
FIG. 5 is another fragmentary elevational view showing attachment of a bottom hole temperature-pressure measurement instrument to the bottom of the tool.

On occasions it may be desirable to record bottom hole temperature and pressure conditions simultaneously with running of the sampling tool. As shown in FIG. 5 the closed lower end of the capsule sub is connected to a known or conventional temperature-pressure recorder, e.g. of the Amerada or Kuster types advertised in the current and past Composite Cataloges of the oil equipment industry under the manufacturers names and indicated at R in FIG. 5.

Figure 2A:
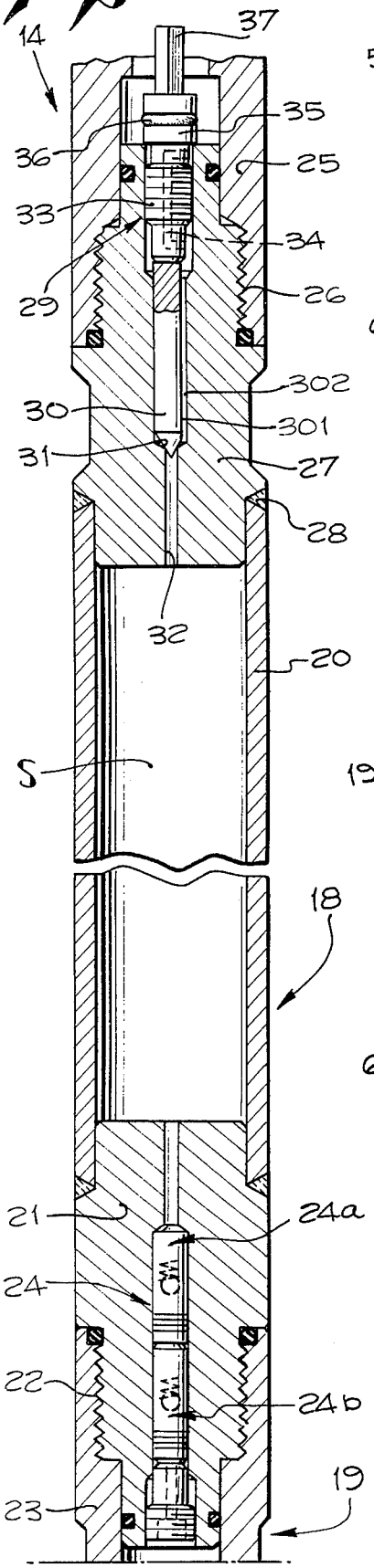
FIGS. 2*a*, 2*b* and 2*c* are longitudinally continuing views showing the tool in enlarged cross section.
Figure 2B:
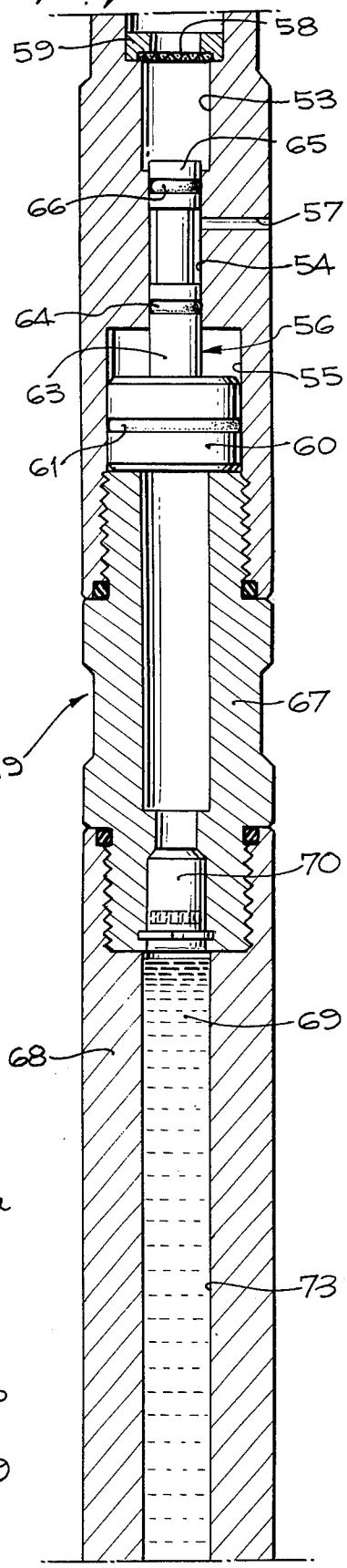
Figure 2C:
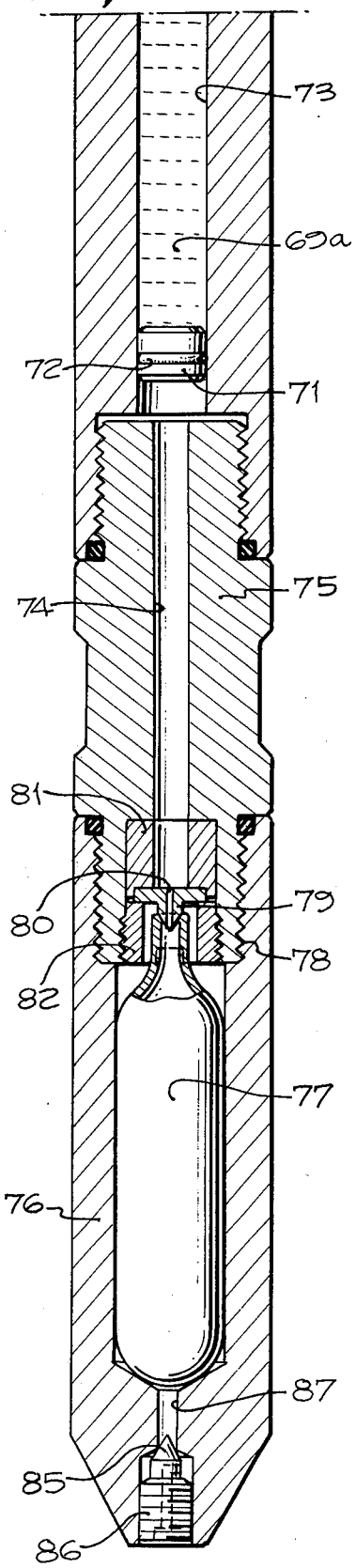

In considering its operation assume the tool initially to be made up at the ground surface with the well fluid intake valve closed as in FIG. 2*b* and the sample chamber evacuated to 29 mm of mercury. The time delay of pressure transmission to the liquid 69*a* is initiated by making up joint 78 to puncture the capsule 77 and release its pressure to the piston 71. As a result of predetermination of the delay the valve assembly 56 is subsequently elevated to its 3*b* position to admit well fluid past the open valve 65 and check valves 24*a*, 24*b* to the sample chamber wherein the sample is sealed to maintain and preserve the well pressure existing at the intake location. As will be understood, the valve 65 and the checks 49 together constitute and function as the sample inlet control and pressure preservation valve means.

Upon retrieval of the tool from the well the sections 18 and 19 are disconnected at the joint 22 leaving the power section for reuse in connection with a replacement upper section. The detached upper section then may be utilized in a testing facility, whether at the well head or other location however remote, for examination of the sample chamber content.

For this purpose a pressure indicator and pressure release fixture shown in FIG. 7 may be utilized. This attachment is shown to comprise a body 90 screwed onto the relief valve sub 27 and into which is threaded a bushing 91 which passes wrench 92 for turning engagement with the flats on the stem of hold-down screw 33. By rotation of the screw the valve needle 30 is released to open in response to the sample chamber pressure, venting the gas through space 301 for communication of its pressure to the gauge 94. With the sample pressure thus determined, the chamber gas pressure may be relieved by opening hand valve 92.

In field use of the invention, after evacuation of the sample chamber and promptly following release of the pressurizing gas in the power section, the tool may be introduced to a well which is under pressure by natural production or as a result of water or gas injection into the formation. Introduction of the tool to the well may be accomplished by use of a conventional elongated tubular lubricator mounted on the well head and initially opened at its upper end to receive the tool and attached wire line. Upon reception in the lubricator its top is closed to seal about the wire line, the well head valve is then opened and the tool lowered to sampling depth. This is conventional lubricator use sequence as applied to other tools or instruments, the reverse of which occurs uponr removal of the lowered objects from the well.

In water and gas injection wells, samples of the bottom hole fluid are taken to determine whether emulsions are present in the hole that could prevent uniform fluid injection into the producing interval. In sampling normal well or gas production, the purpose is to obtain for laboratory analysis as complete as possible determination of the sample spectrum composition at the sampling pressure. For these purposes it is important that sample contamination be prevented because of possible consequences of small material concentrations in the sample.

To illustrate, of significance may be such determinations as the presence and quantities in the sample well fluid of materials ranging from fixed gases, normally gaseous hydrocarbons in the $C_1$-$C_3$ range, and higher boiling normally liquid and solid hydrocarbons that may range in molecular structure as high as asphalts and waxes. As previously indicated, pre-evacuation of the sample chamber assures maximum sample intake, and closure of the chamber to the time of sample intake maximumizes insurance against sample contamination.

I claim:

1. In a well fluid sampling employing a tool containing an initially sealed empty evacuated sample chamber separable from the tool and having top and bottom passages for fluid flow into and out of the chamber, the method that includes lowering the tool on a flexible line to pressurized sampling depth in a well while maintaining the chamber closed against well fluid entry, admitting to and sealing in said chamber a well fluid sample from the sampling depth and from a location in the well bore inwardly from the well formation, preserving in the chamber the well pressure at that depth, withdrawing the tool from the well, relieving the chamber pressure, separating the chamber from the tool, and removing the chamber contents for examination of its contents.

2. Method of claim 1 in which the tool is introduced to the well while it is under pressure.

3. In well fluid sampling employing a tool adapted to be lowered on a flexible line to sampling depth in a well, the tool including a first section containing a closed empty evacuated sample chamber detachably connected to a second section carrying means operable independently of well fluid pressure to maintain the closed condition of said chamber until the sampling depth is reached and to then cause independently of well fluid pressure entry of a well fluid sample to the chamber followed by its closure to retain the sample and preserve the well pressure at the sampling location, said chamber having a bottom sample inlet and a top normally closed fluid vent passage, the method that includes admitting a well fluid sample to said sample chamber by energy derived from within said second section and independently of the well fluid, withdrawing the tool from the well, disconnecting said sections to recover the sample chamber independently of the second section, and transferring and opening said chamber for testing of its well fluid content.

4. The method of claim 3 in which the tool is introduced to the well while it is under pressure.

5. Apparatus for well fluid sampling comprising a tool adapted to be lowered on a flexible line to sampling depth in a well and comprising a first body section containing a closed empty evacuated sample chamber detachably connected to a second power body section, said chamber having a bottom sample inlet and a top normally closed fluid vent passage, means operable independently of the well fluid pressure to admit to and entrap a well fluid sample within said chamber having the pressure and composition existing at the sample location, and means carried by said second body section operable independently of the well fluid pressure to actuate said admitting means after the tool has been lowered to sampling depth in the well, said sections being separable after the tool has been removed from the well to permit separate and independent recovery of said chamber and its contained sample having the composition and pressure existing at the sampling location.

6. Apparatus according to claim 5 in which said admitting means operates to maintain the chamber sample at the well pressure at the sampling depth.

7. Apparatus according to claim 5 in which said first body section is above the second body section and is connected to said line.

8. Apparatus according to claim 7 in which said first body section comprises a tubular extent containing said chamber and having bottom and top joint sections for attachment respectively to the lower second section and said line and inlet and pressure vent valves respectively in said bottom and top joint sections.

9. Apparatus according to claim 8 in which said inlet valve is an upwardly opening check valve contained in a sub threaded into said lower body section.

10. Apparatus according to claim 9 in which said vent valve is contained in a sub threaded into a joint section connecting with said flexible line.

11. Apparatus according to claim 10 in which the vent valve is a needle valve held closed by a screw releasable to vent the chamber pressure through a passage in the screw.

12. Apparatus according to claim 5 in which said body sections are interconnected by a threaded joint.

13. Apparatus according to claim 5 in which said well fluid admitting means includes well fluid entry control valve means and power means in said second body section operable to actuate the valve means.

14. Apparatus according to claim 13 in which said valve means includes a piston initially closing a port in the side of the second body section and displaceable by said power means to open the port.

15. Apparatus according to claim 14 in which said power means includes pressurized liquid for actuating said piston.

16. Apparatus according to claim 13 in which said valve means includes a check valve in said first section operable to seal the chamber after admission of the well fluid sample thereto.

17. Apparatus according to claim 16 in which said valve means includes a check valve in said first section operable to seal the chamber after admission of the well fluid sample thereto.

18. Apparatus according to claim 16 in which said power means includes a body of pressurized liquid and means so restricting liquid escape from said body as to cause said delayed effectiveness.

19. Apparatus according to claim 18 including a gas pressure source means communicating the gas pressure from said source to said liquid body in advance of its restriction.

20. Apparatus according to claim 19 in which said gas pressure source is a chamber containing an opened compressed gas capsule.

21. Apparatus according to claim 13 in which said power means has delayed effectiveness permitting the tool to be lowered in the well with said flow control valve closed and thereafter opened after the tool has reached sampling depth in the well.

22. Apparatus according to claim 13 in which said power means includes pressurized fluid in the second section.

* * * * *